US008981958B2

(12) United States Patent
Price et al.

(10) Patent No.: US 8,981,958 B2
(45) Date of Patent: Mar. 17, 2015

(54) ELECTRIC FIELD COMMUNICATION FOR SHORT RANGE DATA TRANSMISSION IN A BOREHOLE

(75) Inventors: Timothy M. Price, Templeton, CA (US); Donald H. Van Steenwyk, Paso Robles, CA (US); Harold T. Buscher, Los Osos, CA (US)

(73) Assignee: Scientific Drilling International, Inc., Houston, TX (US)

( * ) Notice: Subject to any disclaimer, the term of this patent is extended or adjusted under 35 U.S.C. 154(b) by 397 days.

(21) Appl. No.: 13/567,862

(22) Filed: Aug. 6, 2012

(65) Prior Publication Data

US 2012/0299743 A1 Nov. 29, 2012

Related U.S. Application Data

(63) Continuation of application No. 12/378,514, filed on Feb. 17, 2009, now Pat. No. 8,258,976, which is a continuation of application No. 11/353,364, filed on Feb. 13, 2006, now Pat. No. 7,518,528.

(60) Provisional application No. 60/657,628, filed on Feb. 28, 2005.

(51) Int. Cl.

| | |
|---|---|
| ***G01V 3/00*** | (2006.01) |
| ***E21B 47/12*** | (2012.01) |
| ***E21B 17/02*** | (2006.01) |
| ***E21B 47/14*** | (2006.01) |

(52) U.S. Cl.

CPC ..... *E21B 47/122* (2013.01); *E21B 17/028* (2013.01); *E21B 47/14* (2013.01)

USPC ..... 340/854.3; 340/854.5

(58) Field of Classification Search

CPC ..... E21B 7/121; E21B 17/003; E21B 47/122; H04B 13/00

USPC ..... 340/854.3, 854.5

See application file for complete search history.

(56) References Cited

U.S. PATENT DOCUMENTS

| | | | | |
|---|---|---|---|---|
| 3,866,678 | A * | 2/1975 | Jeter | 340/854.3 |
| 4,532,614 | A | 7/1985 | Peppers | |
| 5,160,925 | A | 11/1992 | Dailey et al. | |

OTHER PUBLICATIONS

Canadian Office Action dated Apr. 11, 2013, for Canadian Application No. 2,597,006 (5 pages).

* cited by examiner

*Primary Examiner* — Albert Wong

(74) *Attorney, Agent, or Firm* — Adolph Locklar

(57) ABSTRACT

The present invention concerns application of a unique conductive electrode geometry used to form an efficient wideband, one- or two-way wireless data link between autonomous systems separated by some distance along a bore hole drill string. One objective is the establishment of an efficient, high bandwidth communication link between such separated systems, using a unique electrode configuration that also aids in maintaining a physically robust drill string. Insulated or floating electrodes of various selected geometries provide a means for sustaining or maintaining a modulated electric potential adapted for injecting modulated electrical current into the surrounding sub-surface medium. Such modulated current conveys information to the systems located along the drill string by establishing a potential across a receiving insulated or floating electrode.

17 Claims, 9 Drawing Sheets

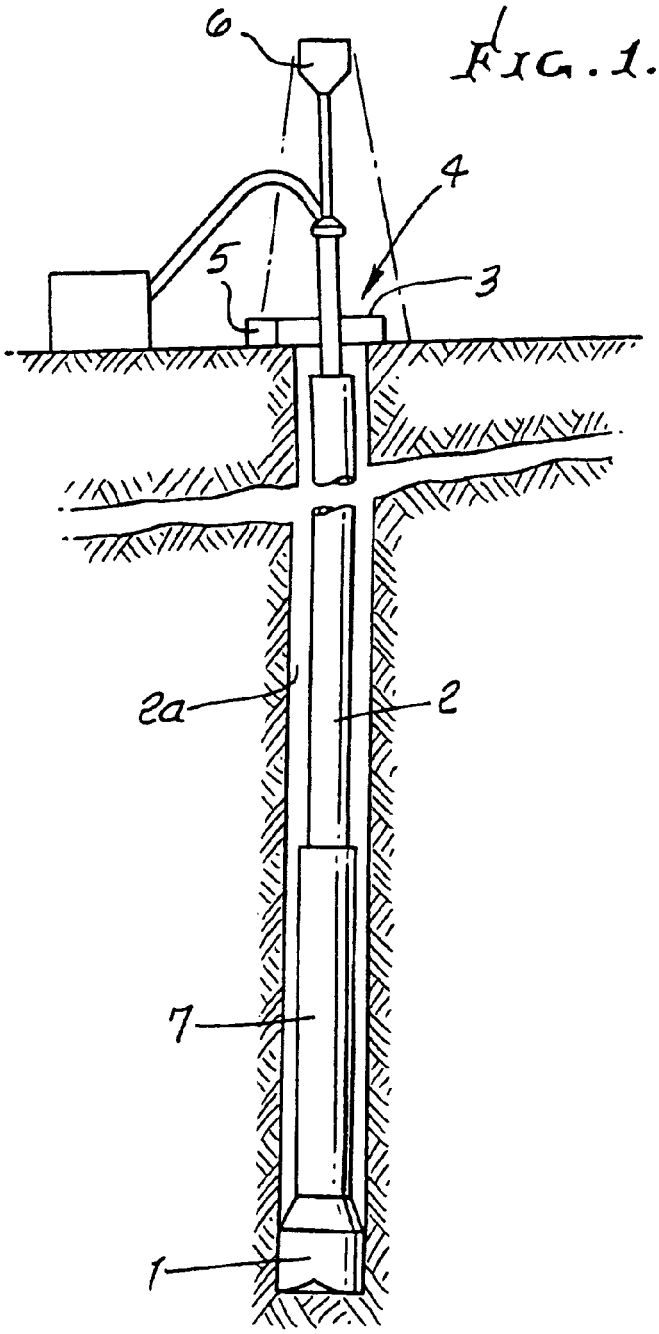
FIG. 1.
FIG. 2.
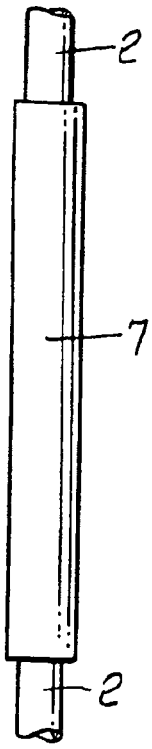

ELECTRIC FIELD COMMUNICATION FOR SHORT RANGE DATA TRANSMISSION IN A BOREHOLE

CROSS-REFERENCE TO RELATED APPLICATIONS

This application is a continuation of U.S. patent application Ser. No. 12/378,514, filed on Feb. 17, 2009, which is a continuation of U.S. patent application Ser. No. 11/353,364, filed on Feb. 13, 2006, now U.S. Pat. No. 7,518,528, which claims priority to and the benefit of U.S. Provisional Application No. 60/657,628, filed on Feb. 28, 2005.

BACKGROUND OF THE INVENTION

1. Field of the Invention

This invention enables or provides for efficient, rapid, wireless communication of drilling information along a drillstring, while drilling is in progress, to allow optimal control of drilling direction and other drilling parameters. In particular, it provides a method for both injecting electrical currents into, and receiving electrical currents from the drilling mud in a borehole and from formations surrounding a drillstring with high efficiency and low propagation loss. In general, it relates to the field of conformal, surface mounted signal transmission and reception electrodes. The compact nature of the electrode apparatus and method allows for communication between any bottom hole assembly components where a wire or large transceiver mechanizations are not practical or possible.

2. Prior Art

Directional drilling of boreholes is a well known practice in the oil and gas industries and is used to place the borehole in a specific location in the earth. Present practice in directional drilling includes the use of a specially designed bottom hole assembly (BHA) in the drill string which includes a drill bit, stabilizers, bent subs, drill collars, rotary steerable and/or a turbine motor (mud motor) that is used to turn the drill bit. In addition to the BHA, a set of sensors and instrumentation, known as a measure while drilling system (MWD), is required to provide information to the driller that is necessary to guide and safely drill the borehole. Due to the mechanical complexity and the limited space in and around the BHA and mud motor, the MWD is typically placed at least 50 feet from the bit above the motor assembly. A communication link to the surface is typically established by the MWD system using one or more means such as a wireline connection, mud pulse telemetry or electromagnetic wireless transmission. Because of the 50 foot. lag between the bit location and the sensors monitoring the progress of the drilling, the driller at the surface may not be immediately aware that the bit is deviating from the desired direction or that an unsafe condition has occurred. For this reason, drilling equipment providers have worked to provide a means of locating some or all of the sensors and instrumentation in the limited physical space in or below the motor assembly and therefore closer to the drill bit while maintaining the surface telemetry system above the motor assembly.

One of the primary problems that must be overcome to locate sensors below the mud motor is the establishment of a communications link that can span the physical distance across the mud motor and be compatible with the construction of the mud motor and BHA. Prior art exists using three basic technological means, wired conduction through the mud motor, acoustic transmission and finally wireless electromagnetic communication.

An example of prior wired conduction art is U.S. Pat. No. 5,456,106 (Harvey, et al), which describes a modular sensor assembly located within the outer case of a downhole mud motor between the stator assembly of such a motor and the lower end of the outer case, where radial and thrust bearings are located. This sensor assembly is connected to a region above the stator by a wire mounted in the outer motor case.

U.S. Pat. No. 5,725,061 (Van Steenwyk, et al) is another example of a non-telemetry method of getting near-bit sensor data through a mud motor. This describes a way to run signal wires through the rotor of the motor, with slip-ring type electrical contacts at each end of the motor.

Wires allow transmission of both electrical power and signal data, but are mechanically difficult to implement and electrically maintain in the downhole environment and are not widely used due to these deficiencies.

An example of an acoustic based transmission system applied to a short hop application is described in U.S. Pat. No. 5,924,499 (Birchak et al). An array of acoustic transmitters is described that can pass signal through multiple paths to a receiver wired to the MWD system located above the motor assembly.

The complexity of this systems in terms of the mechanical packaging of the acoustic transmitters and receivers as well as the complex signal processing necessary to decode signals in the presence of the large acoustic noise inherent in drilling makes this method costly and prone to reliability problems.

Wireless electromagnetic communication on drilling assemblies has a long history of prior art starting with U.S. Pat. No. 2,354,887 (Silverman et al) which describes a toroid core with a primary winding wound on the core and the drill string located through the center opening of the toroid producing a one turn secondary. Current is induced in the drill string which travels to the surface where a potential difference is measured as the current returns through the earth.

U.S. Pat. No. 5,160,925 (Daily et al) uses a similar toroid method for both launching and receiving the signal in the drill string. Such toroids have the disadvantage of being thick cross-section structures (for both strength in the high-vibration drilling environment, and to avoid permeability saturation), and that they must be shielded from abrasion due to contact with the mud/borehole walls. These requirements mean that a deep groove, usually about one inch in depth, must be cut around the outside wall of the sub or other drillstring element hosting the toroid. This substantially weakens the element, already subject to high torque and bending forces, especially near the bit. Secondly, the toroid must be constructed as a split ring to fit over the host structure, wound with wire, and then reassembled in place to precision tolerances (to avoid high coupling losses). It must finally be encapsulated with an insulating polymer to hold it in place, and covered with a complex, slotted steel shield. All this makes use of the toroid method expensive as well as creating more potential points of failure due to the complex structure required for packaging.

A second type of wireless electromagnetic communication as described in U.S. Pat. No. 6,057,784 (Schaaf et al) comprises a solenoid coil wound about a center line of the drill string axis either on a separate drill string sub or as part of the bit box of the drill bit. A plurality of ferrite bars distributed about the inner circumference of the coil embedded in the body of the transmitter sub enhance the launching of the magnetic field into the drill assembly, surrounding borehole and earth. Surrounding the outer diameter of the coil is a slotted shield which provides protection from the borehole environment while allowing a propagation path for the magnetic field. Located above the mud motor, a second solenoid assembly similar or identical to the transmitter receives the signal in the reciprocal process used to launch the magnetic field As with the toroid method described in U.S. Pat. No. 5,160,925, the transmitter and receiver described in U.S. Pat. No. 6,057,784 are complex and therefore costly to maintain and manufacture.

All of the prior art methods describe complicated mechanical structures using a large number of parts and assemblies for construction of the transmitter and receiver. Due to the large cross section required to house them, the large coils and magnetic components described in the prior art reduce the strength of the bit sub while increasing its cost and size. A long drill string sub is undesirable between the motor and the bit because it adds additional flexibility to the assembly in this area which in turn makes the assembly more difficult to control. In addition, typical transmissions methods and devices operate at frequencies below 10 Hz which is too slow to support many of the recent active drill string components that require real time control information from the MWD system.

For these reasons, a method is required that can provide a communications link across drill string components such as a mud motor or rotary steerable using a means that can be implemented without weakening the structure of the drill string components while providing a high data transmission rate at low power.

SUMMARY OF THE INVENTION

The present invention provides a means for establishing a compact wireless bi-directional communication link between two transceivers located on the bottom hole assembly (BHA) of an oil or gas drilling assembly where a wired connection cannot be practically made. One particular embodiment of the invention solves the problem of how to send data from sensors proximate to the drill bit around rotating machinery, such as a mud motor, to an MWD system located above said mud motor. In one implementation, there is information transmission in both the uphole and downhole directions, the downhole being for either control or interrogation purposes or for both.

Basic steps for the method of the invention include:

a) providing well status sensor means proximate the drill bit in the hole, b) transmitting well status data from said sensor means to an upper intermediate transceiver station such as an MWD located above, c) said intermediate station retransmitting said data to the well surface, d) data transmission provided via electric field conduction transmission.

The invention employs signal transmission by electric field using an electrode insulated from the drill string but in direct contact with the surrounding mud, rather than the toroid induction method typically used for downhole telemetry. Such a reliable link, with bandwidth exceeding 15 kHz has been demonstrated by the applicants, over more than 50 feet of range, downhole, using less than 2 Watts of continuous wave (CW) transmit power.

Apparatus of one embodiment of the present invention uses a unique combination of the conductive electrodes to establish a two-way data link between near-bit sensors and the MWD transceiver uphole. The near-bit transceiver sub employs a small recessed insulated electrode as the means to communicate bi-directionally with the MWD. The MWD electrodes may be one of two types. If the MWD is an electromagnetic type, the upper electrode of the link is simply the insulated gap electrode that is used by the MWD for transmitting to the surface. If the MWD is the mud pulse type, the upper link electrode may be a recessed insulated type similar in construction to the near bit electrode. Tests have shown these electrode configurations to be remarkably robust to mud and formation resistivity extremes that might be encountered in the drilling application.

The advantages of the recessed electrode configurations are that they minimize the reduction in the drill string element outer wall thickness that reduces the high torque and bending strengths required near the bit. The simple geometry allows implementation in a much smaller physical space which allows realization of transceivers in a variety of locations near the bit, within the mud motor, or, in a rotary steerable system.

The insulating gap electrode located above the motor, has been found reliable in its more benign environment.

An important aspect of the invention is the use of direct electrical injection of signal currents into the borehole environment and the direct electrical detection of such currents using insulated electrical contacts that may be small buttons, bands around the drill string or strips along the exterior of elements in the bottom hold assembly. The small sizes and configurations made possible using the insulated contact method allows for communication between multiple sensor systems in the bottom hole assembly, where wire or large transceiver mechanizations do not fit within available space.

BRIEF DESCRIPTION OF THE DRAWINGS

FIG. 1 shows a well installation;

FIG. 2 shows down-hole apparatus incorporating the invention;

FIG. 4*a* shows an implementation of a recessed band electrode sub that allows short range, wired communication with system controller and mud pulser subs when a mud pulser is used as the lower terminus of a surface datalink, in place of an electric field gap-type transceiver.

FIG. 4*c* is an end view of FIG. 4*a;*

DETAILED DESCRIPTION

Figure 3:
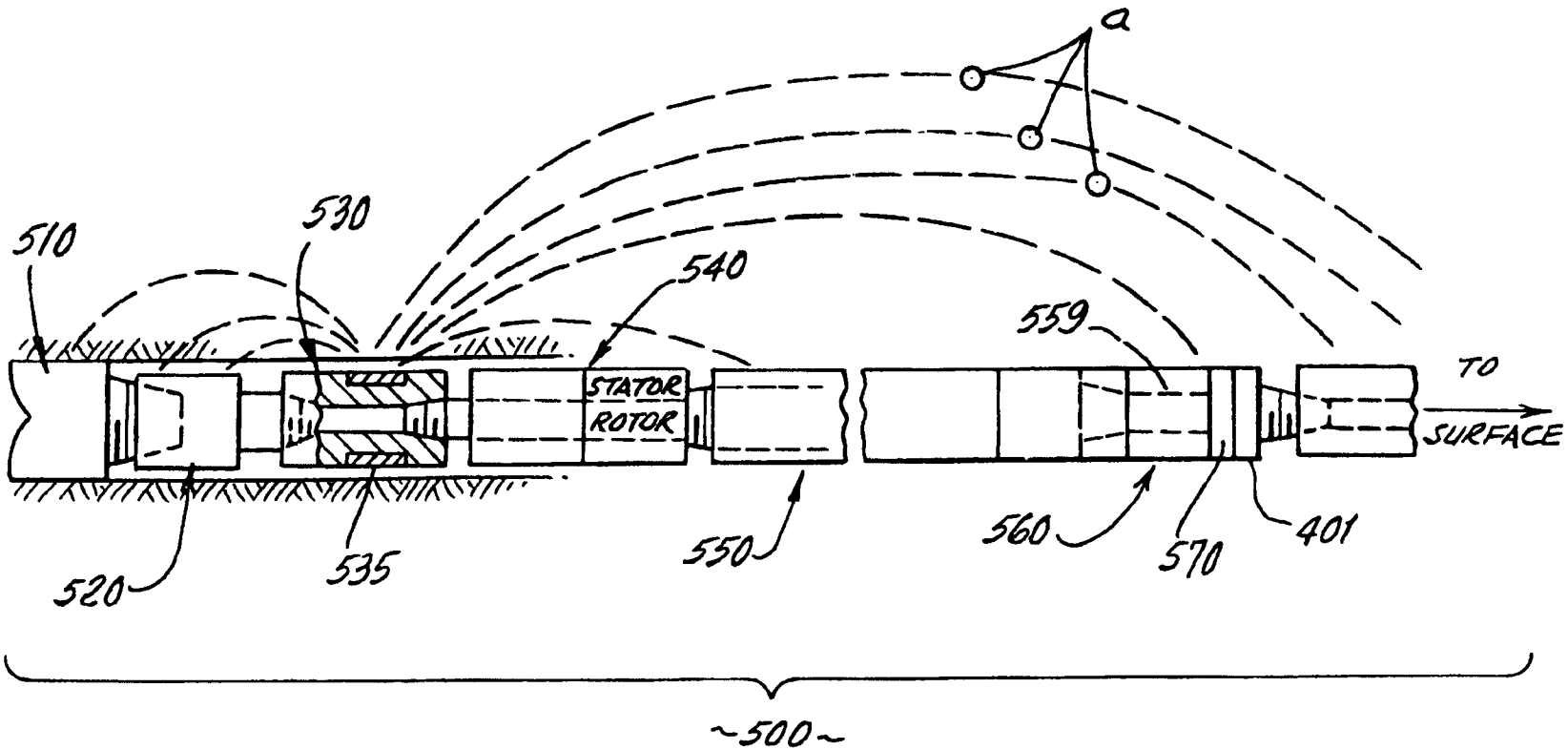
FIG. 3 shows the general arrangement of the electric field pure conduction short range communication apparatus of the present invention.

FIG. 1 shows diagrammatically a typical rotary drilling installation of a type in which the present invention may be used. The bottom hole assembly includes a drill bit 1 connected to the lower end of drill string 2 which is rotatably driven from the surface by a rotary table 3 on a drilling platform 4. A suitable drilling fluid, generally referred to as mud, is pumped downward through the interior of the drill string 2 to assist in drilling and to flush cuttings from the drilling operation back to the surface in the annular space 2*a* outside of the drill string 2. The rotary table is driven by a drive motor 5. Raising and lowering of the drill string, and application of weight-on-bit, is under the control of draw works indicated diagrammatically at 6. The bit may alternatively be rotated by a mud-motor, contained within 7, located in the string.

FIG. 2 shows apparatus incorporating the invention, as also seen in FIG. 1.

Two embodiments of apparatus of 7 are provided by the current invention. Referring to FIG. 3, the first and preferred embodiment uses an insulated band recessed conductive electrode 535 on a sub 530 at a lower location below a bit rotating mud motor 540 or other mechanical means 550 and an insulating gap type electrode 570 on a sub 401 above such a motor or mechanical means. The gap electrode arrangement can serve as both the upper electrical contact for the short hop communication link of the present invention and as the lower terminus of a surface link. The second, alternate, embodiment is suitable and sufficient if the surface communication link is of the mud pulse type. For this embodiment, the insulated gap electrode 570 would be replaced by a mud pulser, not shown, and the sub 560 shown in FIG. 4*a*. This second embodiment uses recessed, insulated conductor type electrodes at both ends of the short hop link, one 535 near the bit and the other at 20 (FIG. 4*a*) near the mud pulser, above a motor or other physically obstructive mechanical means. Band type, recessed, insulated electrodes are shown for illustrative purposes, although other shapes of recessed, conductive electrodes may be used. The upper electrode 20 and its associated short-hop receiver (transceiver) are in wired communication with the mud pulser control sub, contained in elongated housing 560 (FIG. 3).

Figure 4:
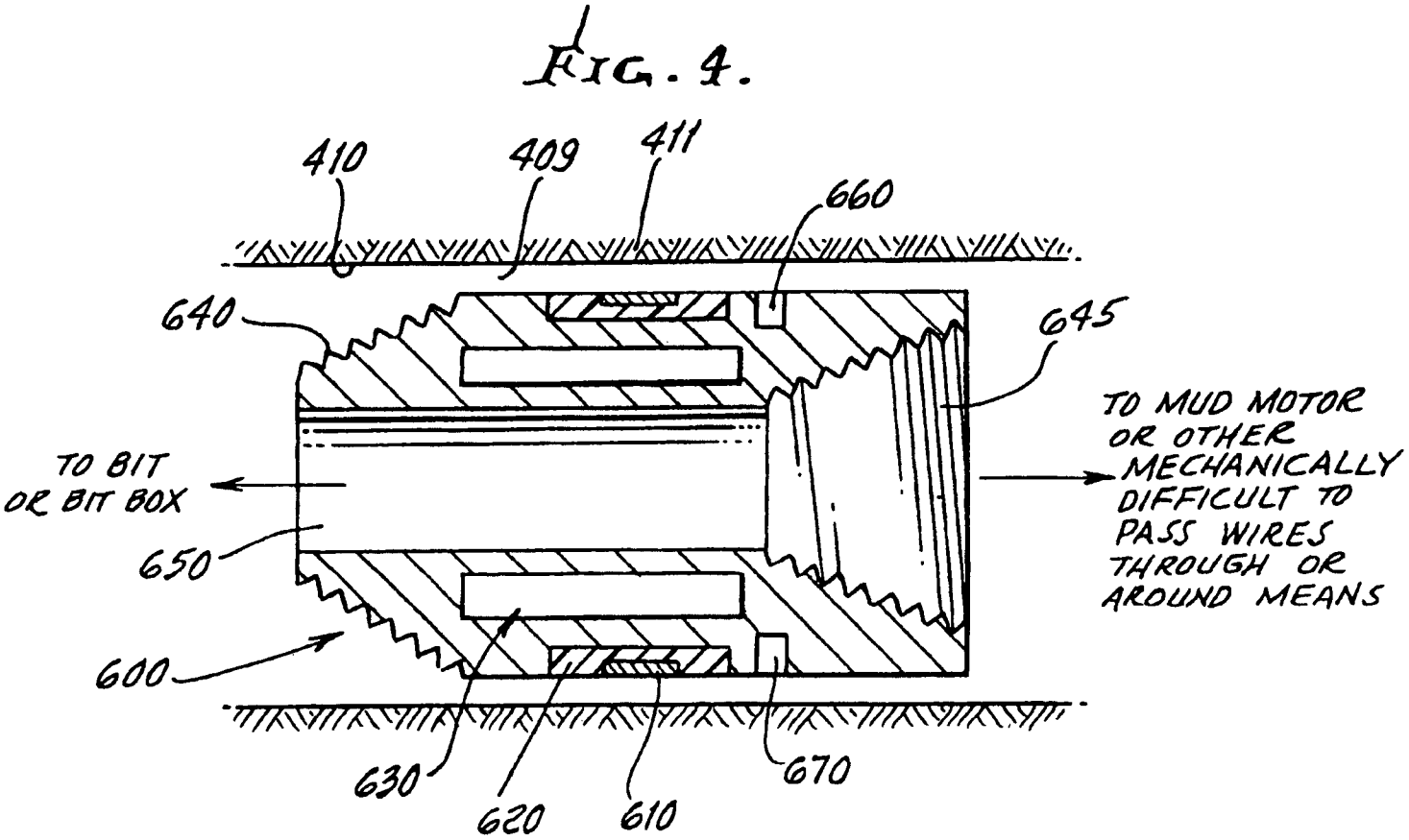
FIG. 4 shows details of one example of a near-bit transceiver element for the present invention.
Figure 9A:
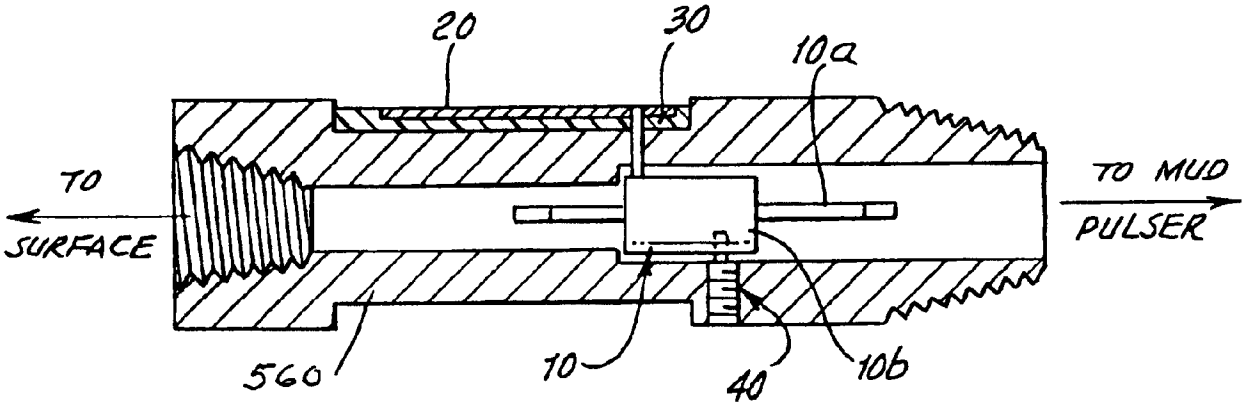
Figure 9C:
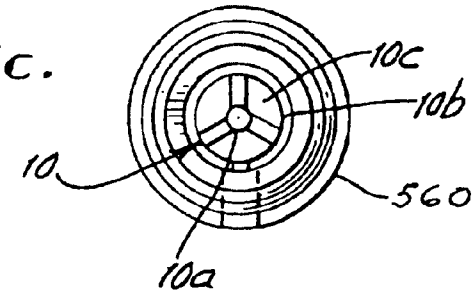

The first, preferred, embodiment of the present invention, referring to FIG. 3 and to FIG. 4, includes of a near-bit sub 530 (FIG. 3) or 600 (FIG. 4), containing a power source, drilling environment sensors, a memory circuit and communication management controller, and a transmitter and receiver, all housed in space 630 and electrically connected to a cylindrical, metal band electrode 610 received in a solid dielectric-filled groove 620 in the outer wall of the sub. The electrode is exposed to be in electrical contact with the surrounding drilling mud at 409 in the hole 410, and communicates by driving an AC, data-modulated current into the mud and subsequently into the formation 411. This current is picked up by the uphole insulated gap electrode, or electrodes, 570, demodulated, and stored in memory circuitry contained in space 559 in sub 560, in preparation for transmission by an associated electric conduction surface link. The return short hop data link functions similarly, but the uphole insulated gap electrodes 570 transmit interrogation or control-format data to the lower, near-bit sub, 530 or 600.

The short hop link typically supports data rates in the 10 to 50,000 baud range. Link carrier frequencies are expected to be in the 100 to 100,000 Hz range. Both recessed conductive and gap electrode types involved are broad band relative to this range. A plurality of codes and frequencies are typically used, depending on the link function and local conditions. Codes can be, but are not limited to, Frequency Shift Keying (FSK), Pulse Width Modulation (PWM), Pulse Position Modulation (PPM), Frequency Modulation (FM) and Phase Modulation (PM). Single and multiple simultaneous carrier frequencies may be used, both within and outside of the expected frequency range. Electric field transmission in both mud and the formation is utilized.

The lower near-bit sub 530 or 600 receiver can be commanded by circuitry at the upper sub 560 (FIG. 3) to modify its data collection, memory use, transmission schedules and other functions. The upper sub may be in contact with other nearby sensor tools; and may contain or be in contact with management and control electronics sufficient to constitute an MWD system. Referring to FIG. 3, the MWD sub 560 uphole, above the mud motor 540 and other possible collars and subs 550, contains the sensors, power supplies, control processor and electronics, not shown, required to both communicate upwardly with surface equipment and downwardly with the near-bit sub, with the end objective of collecting and communicating the most useful drilling condition data to the surface in a timely fashion. In the preferred implementation, this sub 560 contains the two-way electric field direct conduction means used to communicate with the surface.

FIG. 3 also shows the general arrangement of the first, preferred, embodiment of the present invention, a pure conduction datalink between the band electrode on the near-bit sub and the insulating gap above the mud motor and various other subs and collars. The lower downhole assembly 500 consists of a drill bit 510, a bit box 520, a near-bit sub 530, a mud motor 540, a string of subs and collars 550 that may include a mud pulser, and an MWD sensor, and electric field surface conduction transmitter/control subs 560 below an insulated gap electrode 570 in the drillstring.

Referring to both FIG. 3 and FIG. 4, the near-bit sub 600 contains drilling environment sensors and a transceiver, in space 630, for both sending their outputs to the uphole surface link sub 560 transceiver, and for receiving commands from that transceiver. The MWD sensor/control sub 560 is in wired communication with the surface link transceiver sub, also in 560, and submits its own sensor output data to it. The surface link sub contains storage and control processors that are in two-way communication with surface operators in the preferred embodiment, via the gap-to-surface transceivers that do the upwards and downwardly communication in the sub 560. Both near-bit and upper short hop subs contain power sources, control, memory and communication management functionalities, not shown.

Figure 4B:
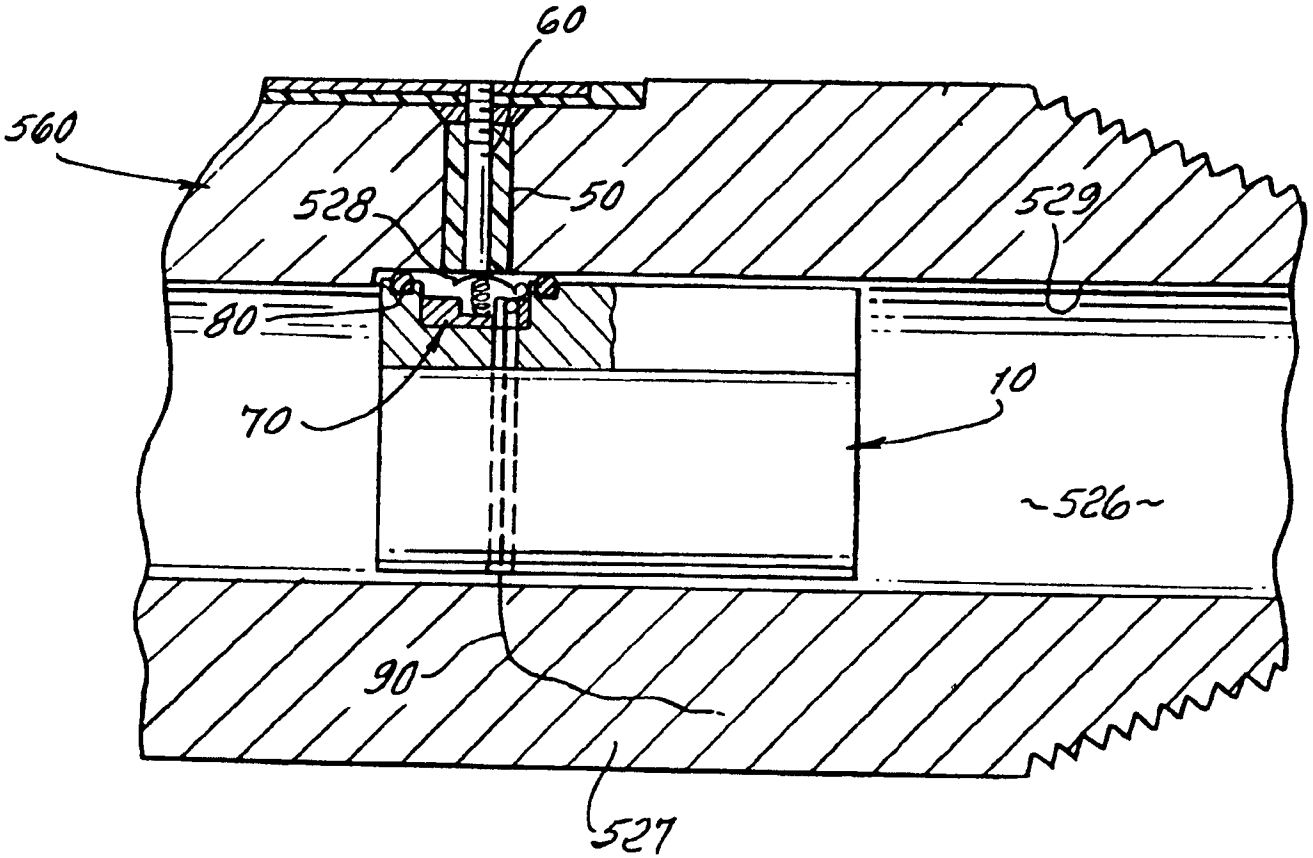
FIG. 4*b* shows details of the electrode contact assembly in 4*a;*

In the aforementioned second alternate embodiment, the surface link sub 560 and associated gap electrodes 570 are replaced with a similar sub shown in FIG. 4*a* and with detail in FIG. 4*b*. A recessed band electrode 20 as referred to above is in two-way communication with the near-bit sub 530 and 600, and would use a mud pulser, not shown, in place of 570, for communication to or with equipment at the well surface.

In the first, preferred embodiment, referring to FIG. 3, the band electrode 535, insulated from the assembly 500 body, injects modulated currents into the mud and formation, and most of such currents return nearby to the assembly body. A fraction of the injected currents—"a" in FIG. 3—returns to the uphole body above the insulated gap 570. These datalink signals produce a voltage across the gap on their way back to downhole assembly 500, and are received, demodulated and stored as near-bit sensor output data. The dashed lines in FIG. 3 represent conduction current paths, as in the formation, assuming the band electrode is transmitting and the gap is receiving. A similar reciprocal current pattern is generated when the gap electrode transmits and the band electrode receives, with the highest current density centered on the gap, and a small fraction being intercepted by the band electrode as command signal currents on their way to the sub body underneath the band electrode. Because the gap conductive uphole and downhole electrodes are axially much longer than the band electrode, they have a greater current collecting and emitting area, which tends to compensate for the lower "gain" of the compact near-bit band end of the link.

In the second embodiment, where the gap is replaced by another recessed conduction electrode 20 (FIG. 4*a*), communication is similar to the above description. The electrode 20 can be made axially longer than the near-bit electrode, to provide more current contact area and link margin, if required.

FIG. 4 shows details of one example of a near-bit transceiver sub 600, common to both embodiments. The sub body is made of steel, with threads 640 and 645 to mate with the bit box and mud motor drive shaft, respectively. The sub is cylindrical in cross section, and may be of larger diameter than adjacent components, for both strength and electronics/battery volume reasons. It has a central circular through channel 650 for drilling mud flow, with appropriate seals. The sub interior includes chambers with appropriate seals for electronics and batteries 630 and for sensor ports 660. There is also a sealed, removable plug 670 that can provide access to a power-on switch. The sensors themselves and their support electronics are mounted in zones or cavities 630. These typically include sensors for the drilling parameters listed under Description of Prior Art, above. Also, their support includes control, sensor activation and data memories, all linked to the uphole MWD/surface conductive subs via an internal transceiver. This transceiver is connected to the metal band electrode 610, which is edgewise supported mechanically by the insulation layer 620. In the preferred implementation, the band is typically titanium, and the insulation may consist of polyetheretherketone (PEEK) or another rugged, vacuum setting epoxy or polymer. Not shown are appropriate electrical leads and pressure-tight fittings connecting the electronics chambers to the electrode and sensor ports. In an alternate implementation, the sub may contain only the electronics payload, with the batteries contained in a separate, removable adjacent sealed sub. There would then be sealed, sliding-contact rotary connectors between these two subs to bring battery power to the transceiver sub 600.

It will be noted that while a circumferential band electrode 610 is shown for illustrative purposes, a number of other geometries are also useful for implementing conduction link electrodes. These include arrays of recessed bands spaced apart axially on the sub, separated from each other by dielectric strips. If selectively connectable to a single, or multiple transmitters, these would allow matching electrode drive point impedance to transmitter capabilities in varying mud salinities. Also included are strips, rectangles and other symmetric and asymmetric geometric shape electrodes that are tailored to optimally utilize the surface area available on a sub or other host carrier. These also may be arrayed and driven selectively to match impedance, similarly to the bands. It has been found experimentally that in general, increasing the total electrode area and the width of the surrounding insulating boundary separating electrode periphery from their host carrier, in both cases, tends to increase link efficiency.

Similarly, link efficiency is a function of the material from which the electrodes and surrounding body are made. Experimentally, it is found that pure lead and lead alloy coatings greatly improve link efficiency over steel or titanium. Also, the choice of electrode edge shape and edge proximity to other sub structures and boundaries has link efficiency effects. It is important to optimization of performance of the links to have awareness of, and control over, the above factors.

For the second, mud pulser surface link embodiment, FIG. 4*a* shows an implementation of an upper band electrode mounted on the surface link sub. This electrode is only for one- or two-way communication with the lower sub of the short hop link. Referring to FIG. 4*a*, the recessed band, 20, is mounted in an insulating bed 30, and is electrically connected to a removable electronics interface 10. Item 10 has standard threaded and connectored ends and is designed to accept a mud pulser or other surface communication means on the right side, with sensor and control tools on the left. Item 10 consists of a central pressure barrel 10*a* and an outer annular sleeve 10*b* supported by three vanes, which allow drilling mud to flow through the assembly gaps 10*c*. The outer sleeve is held against a shoulder of its host sub by the weight of the attached tool string and by a threaded pin, 40, which also fixes its rotational position. Referring to FIG. 4*b*, the band electrode has a metal contact pin 60 threaded into it. The smooth lower portion of 60 is enclosed by an insulating cylinder 50. The inside ends of the pin and cylinder are made flush with the interior wall 529 of the host sub 560. The outer sleeve and thick vane of 10 support a sliding, spring-loaded electrical contact assembly 70. Assembly 70 consists of a cylindrical insulating block on which is mounted a thin, rounded, spring steel contact 528 pressed against the inner wall of the sub by a coil spring. The contact presses against the end of the threaded pin when assembled, making electrical connection to the band electrode. An insulated wire 90 connects the spring steel contact to the transceiver inside the central pressure barrel tool string. In the embodiment shown, the wire passes through a cylindrical pressure seal channel before entering the barrel 527. Double or quadruple "O"-ring seals 80 in the outer sleeve seal the sliding contact against drilling mud 526. High temperature silicone cement offers one way to form pressure seals in the wire channel, and between 50, 60 and the sub wall.

Figure 5:
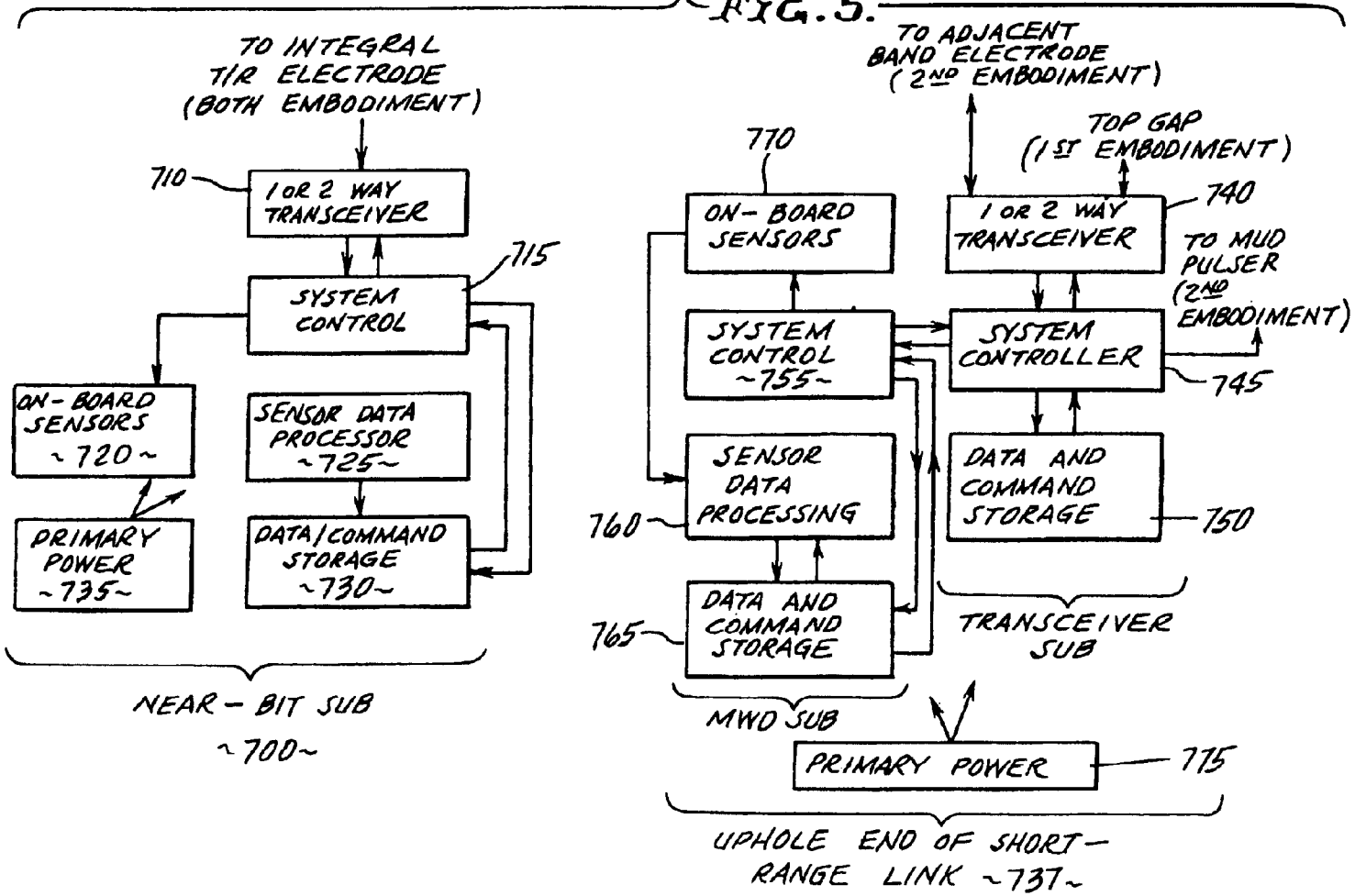
FIG. 5 shows a block diagram of typical transceiver electronics for the present electric field short range data link apparatus.

FIG. 5 shows a block diagram of the typical electronics for the present short range datalink. The near-bit end of the link, 700, generally contains a primary power source, sensors, control, signal processing and storage, and a short-range communication transceiver. In certain alternate embodiments, the transceiver may only be a transmitter. The uphole end of the short range link, 737, generally consists of a transceiver sub and an MWD sensor sub, in wire communication. The transceiver sub can in the first, preferred embodiment, maintain two-way communication with both surface operators and with the near-bit sub, using one gap-type transmit/receive electrode pair. This sub in general contains downhole and uphole transceivers, a surface-reprogrammable system controller and sensor data collection/transmission/interrogation management function, storage and primary power. The surface and short-range links may be different in frequency, power and modulation formats. The surface transceiver may also be used to communicate with the near-bit sub, either with the same or different signals it uses to communicate with the surface. The MWD sub contains sensors, signal processing, storage and primary power. In the second, alternate embodiment, the electric field two-way surface link, not shown, is replaced with an uphole direction only mud pulser, not shown. The transceiver sub then performs as the autonomous, pre-programmed system controller, independent of the surface. Its short-range transceiver is then connected to an adjacent recessed band; conduction electrode sub 560, shown in FIG. 4*a*, and its surface transceiver is replaced with a mud pulser controller resident in its system control module 745 in FIG. 5. In this case, the near bit sub may be controlled by the associated system control 745, or, by the nearby MWD system control 755 in that sub, which is in wire communication with the surface link sub.

Referring to FIG. 5, the near bit sub 700 comprises the transceiver 710, its own system controller and communications management 715, sensors 720, sensor data processor 725, data and command storage media 730 and local primary power 735. This sub is interrogated by either 745 or 755 via the short hop link. In the uphole end, 737, of the short range link, the MWD sub comprises a system controller 755, sensors 770, associated sensor data processing 760, and data storage 765. This sub is in wire communication with the transceiver sub, comprising transceiver 740, system control 745 and storage 750. Both sets of subs are dependent on their own primary power supplies, 775. Depending on which implementation of the surface link is present, either gap or mud pulser, control programming, functions and transceiver 740 communication frequencies and protocols will be changed appropriately.

It is contemplated that other, simpler, alternate implementations exist, wherein all communication is unidirectional only. In the uphole only case, the near-bit sub transceiver 710 reverts to a transmitter and the uphole transceiver 740 reverts to only a short-range link receiver. System control 745 would then send near-bit and MWD sensor data to the surface via a mud pulser.

It is expected, and has been confirmed in laboratory and downhole experiments, that drilling conditions, particularly mud salinity changes, will affect short hop link signal-to-noise (S/N) ratios at a fixed transmit power. For this reason, it is useful in all embodiments to actively control the transmitted power in response to the drilling environment, so as to minimize power draw while maintaining adequate S/N. This can be done in both one- and two-way short range links. In the former, transmit electrode drive impedance changes are directly related to mud salinity, and can be used to infer link losses. In the latter case, received signal S/N can be measured and reported back to the transmitter for output adjustments to be made.

In some cases, the changes in transmit efficiency can be a measure of the formation resistivity changes where the mud resistivity is constant or the electrode is pushed against the bore hole wall. For this reason, embodiments of the invention can benefit by measuring and storing the transmit efficiency for use in determining formation resistivity or for correlating to previously known formation resistivities. Thus, the transmit efficiency may be computed and stored for the upper location to lower location in the well bore, and the lower location to upper location, and is used as an indicator of the change in formation resistivity. A means to measure and/or compute and/or store transmit efficiency is indicated at 812 in FIG. 8.

The short hop subs typically use the pure conduction datalink to communicate with each other. The surface link sub uses the same insulated gap type electrodes to communicate with both the near-bit sub and the surface, in the first, preferred electric field conduction surface link embodiment.

Figure 6:
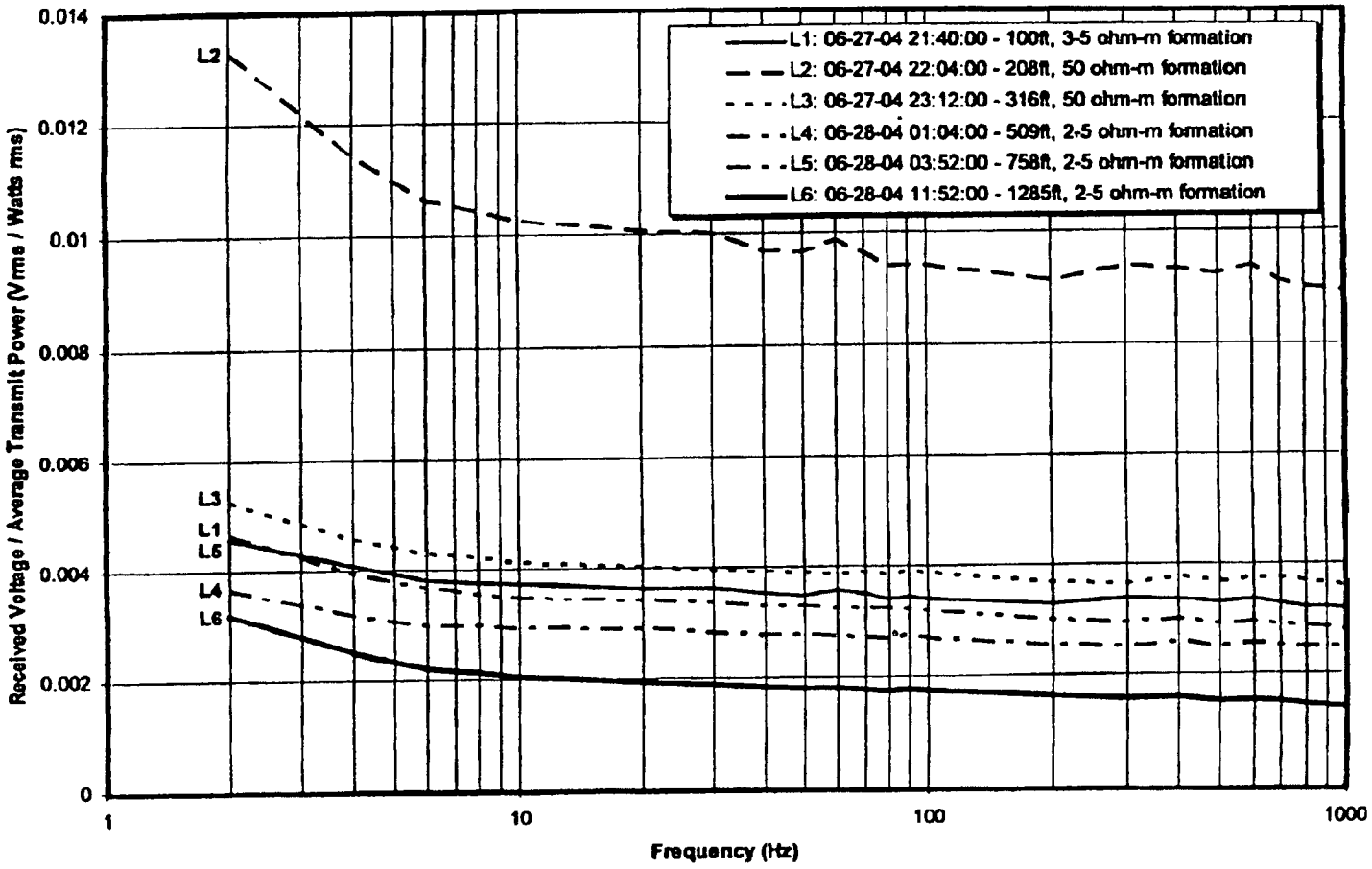
FIG. 6 shows measured downhole efficiency for a pure conduction, band-to-gap electrode datalink of the present invention type.

FIG. 6 shows downhole measured performance of a pure conduction type datalink, using a band-type transmit electrode and the insulated gap receive electrodes of the first embodiment of the present invention. The titanium band, 0.75 inches wide, was 58 feet below a 2 inch gap receiver. Both were on a 6.5 inch O.D. drillstring. The near-bit sub was as described in FIG. 4, with the batteries contained in the same sub as the electronics. Rather than carry actual sensors, the sub included a pre-programmed signal generator that repeatedly transmitted stepped frequency segments over the same signal frequency band that actual sensors might use, so as to methodically test the entire spectrum supported by the link. The uphole insulated gap receiver sub was of the same type described in U.S. Pat. No. 5,883,516. Its surface link transmitter was turned off. Its surface link receiver was replaced by a wider-bandwidth short-hop link receiver which stored in memory all signal waveforms received. Background link noise, in the absence of any transmission, was also periodically recorded by the gap receiver. The near-bit transmitter sub also included complete output waveform recording. Thus, the entire link signal-to-noise performance was reconstructed from the two memories as a function of frequency, time and drilling depth.

A measure of the link efficiency, Received Voltage/Average Power, is the ratio of voltage received at the upper gap electrodes divided by power transmitted by the lower band electrode. This is plotted in FIG. 6 as a function of frequency, for six depths, including the 1285 foot bottom of hole. The nominal mud resistance was 3.2 ohm-m, which was decreasing slightly with time and depth. Formation resistivities varied from a few ohm-m to over 50 ohm-m, and appeared to have little effect on link efficiency. It is likely the L2 curve at 208 feet down showed higher efficiency due to ground water temporarily increasing the local mud resistivity. The received sinusoidal AC signals of between 2 and 13 millivolts for about 1 Watt of transmitted power were more than 10 times noise level. For this pure conduction link, over this short range, there was very little increase in losses with frequency, at least up to the instrumentation limit of 1000 Hz. Subsequent downhole tests under similar conditions showed that this conduction link is usable to beyond 20 KHz. There is every reason, from laboratory model testing, to believe the link performance will improve as mud resistivity increases, and that it will degrade only very gradually as it decreases.

Figure 7:
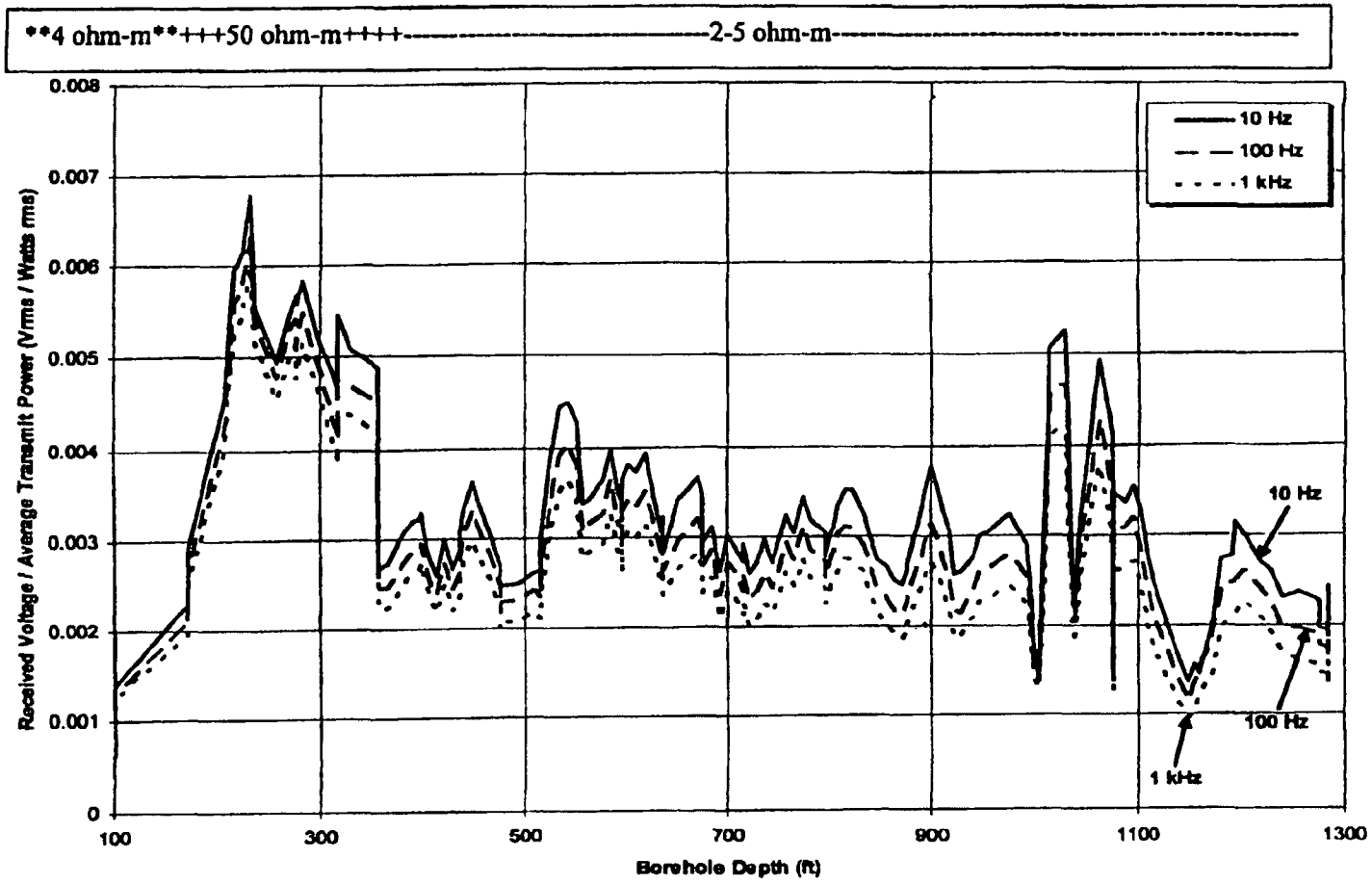
FIG. 7 shows that downhole efficiency while passing through formations varying from about 2 to over 50 ohm resistivity.

FIG. 7 shows the same link efficiency metric versus depth, at fixed frequencies of 10, 100 and 1000 Hz. The link passed through several very different resistivity formations, shown at the top of the figure, with essentially no degradation in efficiency. Neither was there much reduction in efficiency over the 100:1 frequency range of the measurements. There was no casing at the depths shown in the figure.

Finally, four different scaled laboratory experiments, correlated with the 58 foot range downhole data, indicate that the decrease in short range link efficiency with increasing range is quite gradual compared to that seen over longer distances. It was measured as proportional to range raised to exponents between 0.5 and 1. Three downhole tests at link separations of 35, 58 and 90 feet produced range exponents between 0.7 and 0.9.

From separate scaled laboratory experiments, it was found that short range conduction link efficiency is not strongly dependent on the resistivity of the surrounding mud. A factor of one hundred change in resistivity results in only a factor of 7 change in efficiency. Resistivity data was centered around 1 ohm-m, with factor of ten deviations on either side of this. This implies the short hop links will be robust to widely different drilling environments.

The foregoing material has provided a description of one embodiment of the invention showing a means for bi-directional communication between a point below a motor near a drilling bit to a point above the motor, with provision for subsequent transmission of data to the surface of the earth. It will be recognized by those skilled in the art that an important element of the invention is the use of direct electrical injection of signal currents into the borehole environment and the direct electrical detection of such currents using insulated electrical contacts that may comprise small buttons, bands around the drill string or strips along the exterior of components in the bottom hole assembly. This important element may be used for communication between a plurality of components in the bottom-hole assembly or other closely-spaced portions of the drill string.

Figure 8:
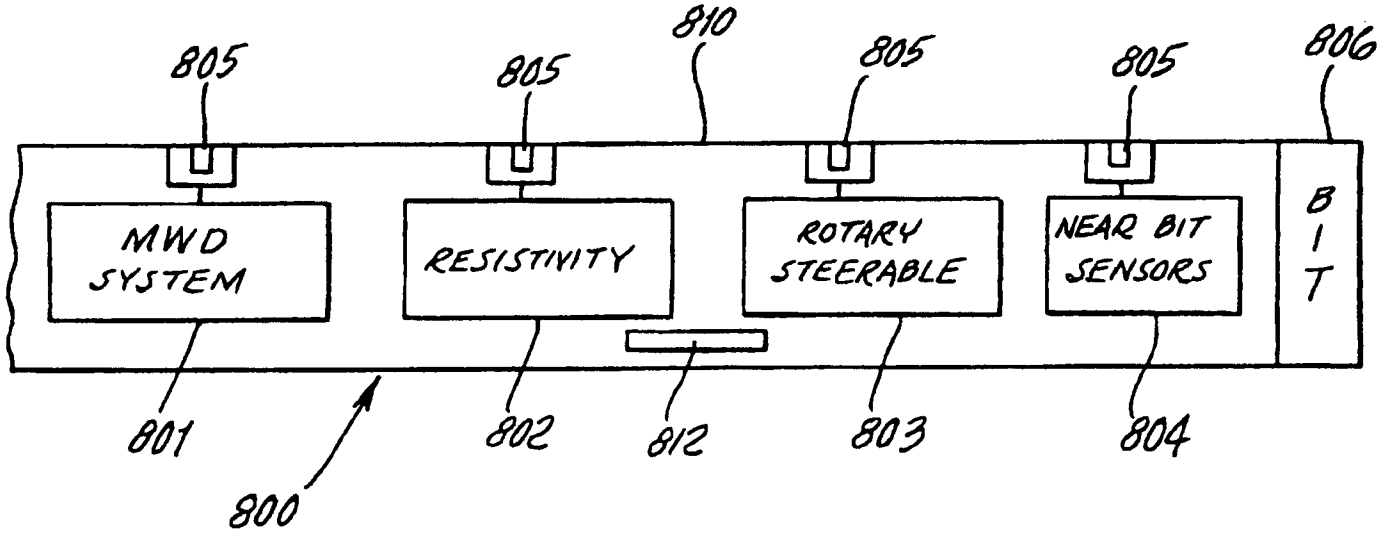
FIG. 8 shows, schematically, a multi-node bottom hole assembly communication system using insulated electrical contacts.

One example embodiment is a multipoint communication network in the bottom hole assembly and drill string wherein a transceiver for each node in the system is utilized. FIG. 8 schematically shows one such multipoint communication network. Numeral 800 designates the bottom hole assembly of the drilling assembly. Mounted within this assembly as a sonde, or built integrally into the drill collars, are an MWD system 801 and a formation resistivity sensor 802. Numeral 803 depicts a rotary steerable device and 804 shows a near bit sensor, located just above the bit 806. Sensor 804 may include devices such as a natural gamma ray sensor, inclinometer or other sensors used in logging or geo steering or boreholes. Four uses of insulated electrodes 805 are shown, which provide the means for injecting the electrical current into the drilling fluid and the earth formation as well as providing the means for receiving a current injected by any one of the other communication nodes in the system. Such electrodes have their outer surfaces at or adjacent the drill string outer surface 810. Data communicated between these nodes can be used by the rotary steerable device 803 to adjust the course of the drilling or can be transmitted to the surface by the MWD system for analysis by the directional driller. The invention in this case enables the wireless means for these independent sensors to share information and use that information to change events in the process of drilling a borehole.

We claim:

1. A wireless communications system for use in a borehole extending from a surface comprising:

one or more downhole subs, each of the one or more downhole subs having an outer surface; and two or more insulated conductive electrodes mechanically connected to the one or more downhole subs wherein the two or more insulated conductive electrodes are in electrical connection with drilling mud;

wherein at least one of the insulated conductive electrodes is adapted to wirelessly receive an electromagnetic transmission from at least one other insulated conductive electrode through the drilling mud or surrounding formation.

2. The wireless communication system of claim 1 wherein the at least one of insulated conductive electrodes is recessed with respect to the outer surface of the downhole sub to which the at least one insulated conductive electrode is mechanically connected.

3. The wireless communications system of claim 1 wherein the insulated conductive electrodes are adapted to wirelessly transmit data at a transmission rate of at least 10 baud.

4. The wireless communications system of claim 1 wherein the insulated conductive electrodes are lead, lead alloy, steel, titanium, or any combination thereof.

5. The wireless communications system of claim 4 wherein the insulated conductive electrodes are lead or lead alloy.

6. The wireless communications system of claim 1 wherein the insulated conductive electrodes are buttons, bands, or strips.

7. The wireless communication system of claim 6, wherein the insulated conductive electrodes comprise two or more bands separated by dielectric strips.

8. The wireless communications system of claim 1 wherein at least one of the insulated conductive electrodes is adapted to communicate with the surface.

9. The wireless communications system of claim 1 wherein the at least one of the insulated conductive electrodes is in electrical connection with a mud pulser.

10. The wireless communications system of claim 1 wherein the insulated conductive electrodes are adapted to transmit into the drilling mud or surrounding formation.

11. The wireless communications system of claim 10 wherein the insulated conductive electrodes are adapted to transmit through a pure conduction datalink.

12. The wireless communications system of claim 10 wherein the insulated conductive electrodes are adapted to wirelessly receive and transmit data at a transmission rate of up to 50,000 baud.

13. A method of communicating in a borehole extending from a surface comprising:

providing a wireless communications system, the wireless communication system comprising a first downhole sub and a second downhole sub, the first downhole sub mechanically connected to the second downhole sub, a first insulated conductive electrode mechanically connected to the first downhole sub and in electrical connection with drilling mud and a second insulated conductive electrode, the second insulated conductive electrode in electrical connection with drilling mud;

wirelessly transmitting an electromagnetic signal from the first insulated conductive electrode to the second insulated conductive electrode through drilling mud or surrounding formation; and receiving the electromagnetic signal with the second insulated conductive electrode.

14. The method of claim 13 wherein the signal is transmitted at an electronic transmission speed of between about 10 and about 50,000 baud.

15. The method of claim 13 further comprising transmitting the electromagnetic signal to the surface from the second insulated conductive electrode.

16. The method of claim 13 further comprising drilling a borehole and wherein the steps of transmitting and receiving occur simultaneously with the step of drilling the borehole.

17. The method of claim 13 further comprising adjusting the course of drilling with a rotary steerable device based on the electromagnetic signal received by the second insulated conductive electrode.

* * * * *